United States Patent [19]

Passmore et al.

[11] Patent Number: 4,950,954

[45] Date of Patent: Aug. 21, 1990

[54] METAL HALIDE DISCHARGE LAMP WITH ELECTRODES HAVING UNEQUAL THORIA CONTENTS

[75] Inventors: Edmund M. Passmore, Gloucester, Mass.; Robert J. Karlotski, Weare; Simone P. Bazin, Bedford, both of N.H.

[73] Assignee: GTE Products Corporation, Danvers, Mass.

[21] Appl. No.: 280,849

[22] Filed: Dec. 7, 1988

[51] Int. Cl.[5] ..... H01J 61/06

[52] U.S. Cl. ..... 313/633; 313/631

[58] Field of Search ..... 313/633, 631

[56] References Cited

U.S. PATENT DOCUMENTS 4,105,908 8/1978 Harding et al. ..... 313/631
4,396,857 8/1983 Danko ..... 313/634
4,633,136 12/1986 Fromm et al. ..... 313/631 X
4,847,534 7/1989 Der Kinderen ..... 313/631 X

FOREIGN PATENT DOCUMENTS 53866 4/1980 Japan ..... 313/633

*Primary Examiner*—Palmer C. DeMeo
*Attorney, Agent, or Firm*—Joseph S. Romanow

[57] ABSTRACT

A metal halide discharge lamp includes an arc tube having a chemical fill, and a pair of electrodes sealed in the arc tube. The electrodes are tungsten and have differing thoria contents. The electrodes with differing thoria contents provide faster starting times than electrodes with equal low thoria contents and eliminate the electrode meltback, voltage increase and lumen loss that is characteristic of electrodes with equal but higher thoria contents. Preferably, one electrode has a thoria content of about 1.5 to 2 weight percent, and the other electrode has a thoria content of about one weight percent or less.

14 Claims, 1 Drawing Sheet

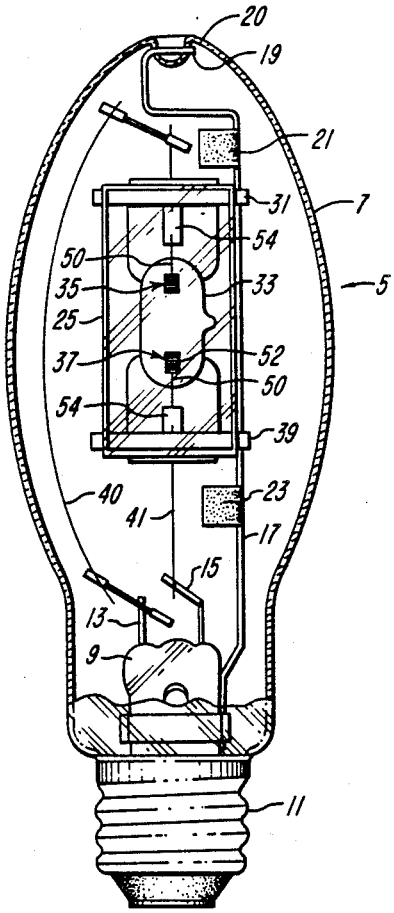
20
19
21
31
7
54
50
35
33
5
25
37
52
50
54
39
40
23
41
17
15
13
9
11

METAL HALIDE DISCHARGE LAMP WITH ELECTRODES HAVING UNEQUAL THORIA CONTENTS

FIELD OF THE INVENTION

This invention relates to metal halide high intensity discharge lamps and, more particularly, to metal halide lamps having tungsten electrodes with differing thorium oxide contents for improved performance.

BACKGROUND OF THE INVENTION

Conventional metal halide discharge lamps include an arc tube having a pair of electrodes mounted therein. The arc tube is mounted in a sealed outer envelope and contains a chemical fill including one or more metal halides. The electrodes are tungsten and commonly include about 0.7% to 2% by weight thorium oxide, or thoria, for increased electron emission from the electrode surfaces. Increased electron emission enhances light output during discharge. In addition, the thoria is radioactive and assists in lamp starting. The starting function is particularly important when the discharge lamp does not include a starting electrode. Low wattage metal halide lamps are disclosed in U.S. Pat. No. 4,620,125 issued Oct. 28, 1986 to Keeffe et al, U.S. Pat. No. 4,625,141 issued Nov. 25, 1986 to Keeffe et al and U.S. Pat. No. 4,415,829 issued Nov. 15, 1983 to Rothwell, Jr. et al.

It has been found that metal halide lamps with electrodes each containing 1% by weight thoria exhibit slow starting. When the thoria content of both electrodes is increased to 2%, the starting times are reduced. However, with 2% thoria content, the electrodes melt back during operation, thereby causing the arc length to be increased. The increased arc length produces increased arc tube operating voltage and wattage, resulting in darkening of the arc tube and loss of luminous efficacy, and sometimes resulting in premature lamp failures. It is desirable to provide metal halide discharge lamps having short starting times and which are not subject to meltback and erosion of the electrodes.

It is a general object of the present invention to provide improved metal halide discharge lamps.

It is a another object of the present invention to provide metal halide discharge lamps having fast starting characteristics.

It is a further object of the present invention to provide metal halide discharge lamps wherein electrode meltback and erosion during operation are limited.

It is a further object of the present invention to provide metal halide discharge lamps having long operating lives.

It is yet another object of the present invention to provide metal halide discharge lamps having essentially constant operating characteristics as a function of time.

SUMMARY OF THE INVENTION

According to the present invention, these and other objects and advantages are achieved in a metal halide discharge lamp comprising an arc tube having a chemical fill including a metal halide, a pair of electrodes sealed in the arc tube, the electrodes including tungsten and having differing thoria contents, an outer envelope surrounding the arc tube, the outer envelope including a base for coupling the discharge lamp to an electrical source, and means for mechanical support and electrical interconnection of the arc tube within the outer envelope.

Surprisingly, it has been found that a metal halide lamp including electrodes having differing, or unequal, thoria contents provides faster starting than electrodes having equal 1% thoria contents. Furthermore, the electrodes with unequal thoria contents eliminate the problems of electrode meltback, voltage increase and lumen loss associated with higher thoria content. Preferably, the electrode with the larger thoria content has a thoria content that is not substantially greater than two weight percent. In a preferred embodiment, one of the electrodes has a thoria content of about two weight percent, and the other of the electrodes has a thoria content of about one weight percent or less. In another preferred embodiment, one of the electrodes has a thoria content of about 1.5 weight percent, and the other of the electrodes has a thoria content of about one weight percent or less.

The disclosed metal halide discharge lamp normally has a vertical orientation during operation. It has been found that the same advantages are obtained whether the electrode with the larger thoria content is located at the top or the bottom of the discharge lamp.

BRIEF DESCRIPTION OF THE DRAWINGS

For a better understanding of the present invention, together with other and further objects, advantages, and capabilities thereof, reference is made to the accompanying drawing which are incorporated herein by reference and in which:

The sole FIGURE of the drawings is a cross-sectional view of one embodiment of a metal halide discharge lamp incorporating the present invention.

DETAILED DESCRIPTION OF THE INVENTION

A typical low wattage metal halide discharge lamp 5 is shown in the FIGURE. An outer envelope 7 is hermetically sealed to a glass stem member 9. The outer envelope 7 may be either evacuated or filled with an inert gas such as nitrogen. An external base 11 provided for easy connection to an electrical source is affixed to the hermetically sealed stem member 9 and outer envelope 7. A pair of electrical conductors 13 and 15 are sealed into and pass through the stem member 9 and are electrically connected to the base 11.

Within the outer envelope 7 is an electrically floating support member 17. Support member 17 extends along an axis that is substantially parallel to the longitudinal axis of the discharge lamp 5 and includes a circular portion 19 at or near the uppermost portion 20 of the outer envelope 7. The circular portion 19, in conjunction with the uppermost portion 20 of the outer envelope, maintains the support member 17 in proper alignment and resistant to deformation due to external shock to the discharge lamp. Getters 21 and 23 are affixed to the support member 17.

Mounted within the outer envelope 7 is a quartz sleeve 25. Metal bands 31 and 39 surround and are affixed to the quartz sleeve 25 and are electrically and mechanically connected to the support member 17.

Within the quartz sleeve 25 is an arc tube 33. The arc tube 33 contains a chemical fill, including a sodium halide and, in a preferred embodiment, includes iodides of sodium and scandium having a ratio in the range of about 20:1 to 28:1. The arc tube 33 also includes electrodes 35 and 37 at opposite end thereof. Metal strap members (not shown) are affixed to the outer surface of arc tube 33 and are connected to the support member 17. The electrode 35 is mechanically and electrically coupled to a wire conductor 40, which in turn is connected to conductor 13. The electrode 37 is affixed to an electrical conductor 41 which is electrically and mechanically connected to electrical conductor 15. Further details regarding the construction of low wattage metal halide lamps are included in U.S. Pat. Nos. 4,620,125 and 4,625,141, which are hereby incorporated by reference.

The electrodes 35 and 37 comprise tungsten containing thorium oxide, also known as thoriated tungsten. In accordance with the present invention, the tungsten electrodes 35 and 37 contain differing amounts of thorium oxide ($ThO_2$). The thorium oxide content in each electrode is preferably not substantially greater than about 2% by weight. All thorium oxide amounts specified herein are weight percentages. Preferably, one electrode has a thoria content of about 1.5% to 2%, and the other electrode has a thoria content of about 1% or less. In a preferred embodiment, the thorium oxide content in one electrode is about 2%, and the thorium oxide content in the other electrode is about 1%. In another preferred embodiment, the thorium oxide content in one electrode is about 1.5%, and the thorium oxide content in the other electrode is about 1.0%. Generally, it is believed that electrodes containing differing thorium oxide amounts of about 2% or less will provide similar results.

It has been found that metal halide discharge lamps having electrodes with differing thoria contents provide faster starting times than electrodes with equal low thoria contents. Furthermore, the electrodes with differing thoria contents eliminate the electrode meltback, voltage increase and lumen loss that is characteristic of electrodes of equal but higher thoria contents.

Each electrode 35, 37 includes an electrode rod 50 of thoriated tungsten and a tungsten electrode coil 52 mounted near one end of electrode rod 50. The coil 52 typically does not contain thoria. The other end of electrode rod 50 is attached to amolybdenum ribbon 54. The electrode is mounted in arc tube 33 so that coil 52 is located in the discharge region, and the ribbon 54 is located in the press seal region. In an example of a 100 watt metal halide lamp, the electrode rod 50 has a diameter of 0.017-inch and a length of 0.29-inch, and extends into the discharge region of arc tube 33 by 0.106 inch.

The use of electrodes with unequal thoria contents has been described in connection with metal halide lamps having electrodes mounted in opposite ends of an arc tube. It will be understood that the invention is applicable to single-ended metal halide arc tubes and to d.c. metal halide lamps as disclosed in the aforementioned U.S. Pat. No. 4,415,829.

EXAMPLE 1

Six 100 watt metal halide lamps were made according to U.S. Pat. Nos. 4,620,125 and 4,625,141, using tungsten electrodes containing 1% thoria each. The electrodes were treated in wet hydrogen for ten minutes at 1050° C. Quartz capsules with a volume of 1.3 cubic centimeters were filled with 16 milligrams of mercury, 12 milligrams of a tricomponent fill comprising 86 weight percent sodium iodide, 10.1 weight percent scandium iodide and 3.9 weight percent cesium iodide, and 0.13 milligrams of scandium metal. The capsules were exhausted and filled with 100 Torr argon and were sealed in a conventional manner. Six additional lamps were made in the same manner, except that the electrodes contained 2% thoria each. An additional six lamps were made in the same manner, in accordance with the invention, with the electrode at the base end of each lamp containing 2% thoria and the electrode at the opposite or dome end of each lamp containing 1% thoria. The lamps were burned at a constant 100 watts for 500 hours in the base up orientation. Photometric evaluation was carried out with the results indicated in Table 1. The standard deviation, $\sigma$, of the data is given in parentheses.

TABLE 1

| | (500 hours) | | |
|---|---|---|---|
| Description | No. of Lamps | Volts ($\sigma$) | Lumens ($\sigma$) |
| Both 1% $ThO_2$ | 6 | 94.0 (2.0) | 8767 (149) |
| Both 2% $ThO_2$ | 6 | 98.8 (5.5) | 7998 (896) |
| Mixed 1%, 2% $ThO_2$ | 6 | 93.3 (2.2) | 8906 (163) |

It is evident from Table 1 that an increase in lamp voltage and a decrease in lumens result when the thoria content is increased from 1% to 2%. In the lamps having electrodes with differing thoria contents, in accordance with the invention, the undesired effects of the increased thoria are eliminated.

The same lamps were burned an additional 500 hours, and the starting times were determined after 1000 cumulative hours. The average starting times, determined in series of repetitive starts, are listed in Table 2.

TABLE 2

| | (1000 hours) | | |
|---|---|---|---|
| Description | No. of Lamps | Total No. of Starts | Ave. Starting Time, Seconds |
| Both 1% $ThO_2$ | 6 | 72 | 95 |
| Both 2% $ThO_2$ | 5 | 40 | 20 |
| Mixed 1%, 2% $ThO_2$ | 5 | 44 | 78 |

Although the improvement in starting time with mixed thoria electrodes is less than the improvement with equal 2% thoria electrodes, the 18% decrease from 95 seconds to 78 seconds represents an improvement over the prior art. The improvement is particularly useful, since no offsetting increase in voltage, decrease in lumens or other deleterious effects are observed. The same lamps were then burned an additional 2000 hours and were photometrically evaluated at 3000 hours with the results shown in Table 3. At this point, the lumen output is 18% higher for the mixed thoria electrodes of the invention in comparison with the prior art control lamps in which both electrodes contain 1% thoria. In Table 3, fewer lamps were tested in comparison with Table 1. In this data and in the data which follows, decreases in the number of lamps tested result from lamp failures or other factors which render one or more lamps unsuitable for testing. The voltage differential between the lamps with equal 1% thoria electrodes and equal 2% thoria electrodes has increased further from 4.8 volts at 500 hours to 6.8 volts at 3000 hours, whereas the voltage for the mixed thoria electrodes has remained below that of the lamps with equal 1% thoria electrodes.

TABLE 3

| Description | (3000 hrs) No. of Lamps | Volts (σ) | Lumens (σ) |
|---|---|---|---|
| Both 1% $ThO_2$ | 6 | 98.5 (5.4) | 6175 (570) |
| Both 2% $ThO_2$ | 6 | 105.3 (8.1) | 6515 (939) |
| Mixed 1%, 2% $ThO_2$ | 5 | 96.5 (2.6) | 7326 (264) |

The lamps were then burned an additional 1000 hours and were photometrically evaluated at 4000 hours with the results shown in Table 4. The lamps with mixed thoria electrodes have 15.6% higher lumens than the lamps with equal 1% thoria electrodes and have 8.3% higher lumens than the lamps with equal 2% thoria electrodes. The voltage for the lamps with equal 2% thoria electrodes is still 6 volts higher than the voltage for the lamps with equal 1% thoria electrodes. The voltage stability of the lamps with mixed thoria electrodes is still evident, with the voltage still below that of the lamps with equal 1% thoria electrodes.

TABLE 4

| Description | (4000 Hours) No. of Lamps | Volts (σ) | Lumens (σ) |
|---|---|---|---|
| Both 1% $ThO_2$ | 6 | 101 (6.9) | 5850 (690) |
| Both 2% $ThO_2$ | 6 | 107 (9.2) | 6240 (1000) |
| Mixed 1%, 2% $ThO_2$ | 5 | 99 (1.7) | 6760 (380) |

EXAMPLE 2

Twenty-three 100 watt metal halide lamps including eight lamps with electrodes having equal 1% thoria contents, eight lamps with electrodes having equal 2% thoria contents, and seven lamps with mixed 1% and 2% thoria electrodes, were made in the same manner as described in Example 1. In the lamps with mixed electrodes, the 1% thoria electrodes were at the base end of each lamp, and the 2% thoria electrodes were at the dome end of each lamp, in contrast to Example 1. The lamps were burned base up for 100 hours, and the starting times were evaluated with the results indicated in Table 5.

TABLE 5

| Description | (100 Hours) No. of Lamps | Total No. of Starts | Ave. Starting Time, Seconds |
|---|---|---|---|
| Both 1% $ThO_2$ | 5 | 20 | 114 |
| Both 2% $ThO_2$ | 8 | 79 | 35 |
| Mixed 1%, 2% $ThO_2$ | 5 | 40 | 100 |

Although the decrease in starting time from 114 to 100 seconds with the mixed thoria electrodes is less than the 69% decrease to 35 seconds found with equal 2% thoria electrodes, the 12% decrease with mixed thoria electrodes represents a significant improvement, particularly in view of the absence of added cost or deleterious effects.

The same lamps were burned an additional 400 hours and were photometrically evaluated at a cumulative total of 500 hours with the results indicated in Table 6.

TABLE 6

| Description | (500 hours) No. of Lamps | Volts (σ) | Lumens (σ) |
|---|---|---|---|
| Both 1% $ThO_2$ | 7* | 99.4 (3.5) | 8035 (314) |
| Both 2% $ThO_2$ | 6** | 112.2 (3.8) | 7061 (754) |
| Mixed 1%, 2% $ThO_2$ | 4*** | 94.0 (3.1) | 8167 (132) |

*One lamp of the total made and tested was omitted from this table because of flaking arc tube paint.
**Two lamps were omitted because of flaking arc tube paint.
***Three lamps were omitted because of flaking arc tube paint.

The results are similar to those found in Example 1 after 500 hours. The increased voltage and decreased lumens found with equal 2% thoria electrodes are eliminated when the 2% thoria electrode is replaced by a 1% thoria electrode in the base end of the lamp. In addition to the improvement in voltage and lumens as compared with the 2% thoria electrodes, the mixed thoria electrode lamps showed decreases in the standard deviation of the data. The same improvement is evident in Example 1, as shown in Tables 1 and 3. The effect of a decrease in standard deviation is a more uniform and reproducible product.

In order to investigate the reasons for the observed results, the lamps and electrodes corresponding to Table 6 were examined after 500 hours operation by x-ray radiographs to penetrate the opaque zirconium oxide paint on the arc tube adjacent to the electrodes. In the lamps having equal 2% thoria electrodes, the lower electrode at the dome end of the lamp exhibited erosion. Such erosion is associated with melting back of the electrode. The result of such electrode erosion is an increase in arc length and a consequent increase in voltage drop between the electrodes. No significant erosion occurred at the upper, or base end, electrode. For the lamps having mixed thoria content in which the upper, electrode contains 1% thoria, the erosion of the electrode at the lower end was not observed, and the arc length and voltage remained constant.

It was surprising that decreasing the thoria content of the upper, or base end, electrode would eliminate meltback and erosion of the 2% thoria electrode at the lower end. The following mechanism based on the thermochemistry of the arc tube is a possible explanation of the unexpected phenomenon. It is known that excess iodine ions accumulate at the upper end of a metal halide arc tube during operation. As a result, the driving force for formation of $ThI_4$ vapor is increased at the upper end. The $ThI_4$ vapor migrates to the lower end of the arc tube by convection and/or diffusion down the concentration gradient where it may dissociate to form condensed elemental thorium because of the iodine-forming elements (Hg, Na, and Sc) in the condensate which collects by gravity at the lower end. These elements are available to react with the iodine provided by dissociation of $ThI_4$. The elemental thorium is deposited on the lower electrode, forming a low-melting alloy with tungsten and thereby causing the observed erosion and meltback.

By decreasing the thoria content of the upper electrode, the driving force for formation of $ThI_4$ vapor may be decreased. Less $ThI_4$ is therefore available to migrate to the lower electrode and dissociate to deposit elemental thorium thereon.

EXAMPLE 3

Twenty one lamps were constructed generally in the manner described in Example 1. Seven of the lamps included electrodes with equal 1% thoria contents, seven lamps included electrodes with equal 1.5% thoria contents and seven lamps included electrodes with mixed 1% and 1.5% thoria contents. In the lamps with mixed thoria contents, the 1% thoria electrodes were located at the base, or upper, end of each lamp. The lamps were burned base up and were evaluated for starting with the results indicated in Table 7.

TABLE 7

| Description | (100 Hours) No. of Lamps | Total No. of Starts | Ave. Starting Time, Seconds |
|---|---|---|---|
| Both 1% $ThO_2$ | 5 | 20 | 114 |
| Both 1.5% $ThO_2$ | 5 | 40 | 78 |
| Mixed 1%, 1.5% $ThO_2$ | 5 | 20 | 95 |

In this example, the relative improvement in starting obtained by the invention is as great as that found with the 1% and 2% thoria examples described above. The mixed thoria electrodes yield a 17% decrease in average starting time versus a 31.5% decrease in the case of equal 1.5% thoria electrodes.

The lamps were burned an additional 400 hours and were photometrically evaluated at 500 hours with the results shown in Table 8.

TABLE 8

| Description | (500 Hours) No. of Lamps | Volts(s) | Lumens(s) |
|---|---|---|---|
| Both 1% $ThO_2$ | 8 | 98.8 (3.8) | 7966 (350) |
| Both 1.5% $ThO_2$ | 7 | 100.3 (3.5) | 7510 (670) |
| Mixed 1%, 1.5% $ThO_2$ | 8 | 94.5 (2.0) | 8110 (250) |

Although some of the lamps in Example 3 showed flaking of the zirconium oxide insulating paint which helps keep the ends of the arc tube hot, the flaking was confined to the base, or upper end, i.e. the end opposite the condensate, and thus had no effect on the condensate temperature and the equilibrium vapor pressure of the light emitting species. This was confirmed by comparison of values measured after repainting and rejacketing of the lamps. In Table 8, the results are similar to those obtained in the examples involving 2% thoria electrodes discussed hereinabove, although the decrease in lumens with equal 1.5% thoria electrodes is diminished in comparison to the decrease with equal 2% thoria electrodes.

While there have been shown and described what are at present considered the preferred embodiments of the invention, it will be obvious to those skilled in the art that various changes and modifications may be made therein without departing from the scope of the invention as defined by the appended claims.

What is claimed is:

1. A metal halide discharge lamp comprising:

an arc tube having a chemical fill including a metal halide;

a pair of electrodes sealed in said arc tube, each of said electrodes having a thoria content greater than zero, said electrodes comprising tungsten and having differing thoria contents;

an outer envelope surrounding said arc tube, said outer envelope including a base for coupling said discharge lamp to an electrical source; and means for mechanical support and electrical interconnection of said arc tube within said outer envelope.

2. A metal halide discharge lamp as defined in claim 1 wherein the thoria content of each of said electrodes is not substantially greater than about two weight percent.

3. A metal halide discharge lamp as defined in claim 1 wherein one of said electrodes has a thoria content of about two weight percent, and the other of said electrodes has a thoria content of about one weight percent or less.

4. A metal halide discharge lamp as defined in claim 1 wherein one of said electrodes has a thoria content of about 1.5 weight percent, and the other of said electrodes has a thoria content of about one weight percent or less.

5. A metal halide discharge lamp as defined in claim 1 wherein said electrodes are sealed in opposite ends of said arc tube, and said discharge lamp is intended primarily for vertical operation.

6. A metal halide discharge lamp as defined in claim 1 having a power rating of 100 watts or less.

7. A metal halide discharge lamp as defined in claim 1 wherein one of said electrodes has a thoria content of about two weight percent, and the other of said electrodes has a thoria content of about one weight percent.

8. A metal halide discharge lamp as defined in claim 1 wherein one of said electrodes has a thoria content of about 1.5% weight percent, and the other of said electrodes has a thoria content of about one weight percent.

9. A metal halide discharge lamp as defined in claim 1 wherein one of said electrodes has a thoria content of about 1.5 to 2 weight percent, and the other of said electrodes has a thoria content of about one weight percent or less.

10. An arc tube comprising:

a light-transmissive envelope hermetically enclosing an interior;

a chemical fill including a metal halide within said interior; and a pair of electrodes sealed in said envelope and protruding into said interior, each of said electrodes having a thoria content greater than zero, said electrodes comprising tungsten and having differing thoria contents.

11. An arc tube as described in claim 10 wherein one of said electrodes has a thoria content of about two weight percent, and the other of said electrodes has a thoria content of about one weight percent or less.

12. An arc tube as described in claim 10 wherein one of said electrodes has a thoria content of about 1.5 weight percent, and the other of said electrodes has a thoria content of about one weight percent or less.

13. An arc tube as described in claim 10 wherein one of said electrodes has a thoria content of about 1.5 to two weight percent, and the other of said electrodes has a thoria content of about one weight percent or less.

14. An arc tube as described in claim 10 wherein said arc tube has a power rating of about 100 watts or less.

* * * * *